US007345434B2

(12) United States Patent
Takahashi et al.

(10) Patent No.: US 7,345,434 B2
(45) Date of Patent: Mar. 18, 2008

(54) DISCHARGE LAMP LIGHTING APPARATUS AND LUMINAIRE

(75) Inventors: Yuji Takahashi, Kanagawa-ken (JP); Go Kato, Kanagawa-ken (JP); Yanbin Sun, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 11/388,198

(22) Filed: Mar. 24, 2006

(65) Prior Publication Data

US 2006/0226794 A1 Oct. 12, 2006

(30) Foreign Application Priority Data

Mar. 24, 2005 (JP) ..... P2005-085995
Jun. 24, 2005 (JP) ..... P2005-184285
Jan. 26, 2006 (JP) ..... P2006-017272

(51) Int. Cl.
*H05B 41/36* (2006.01)

(52) U.S. Cl. ..... 315/307; 315/291; 315/209 R

(58) Field of Classification Search ..... 315/224, 315/209 R, 291, 307, 225, 308
See application file for complete search history.

(56) References Cited

U.S. PATENT DOCUMENTS 5,063,490 A * 11/1991 Maehara et al. ..... 363/37
5,500,792 A * 3/1996 Jeon et al. ..... 363/98
5,521,467 A * 5/1996 Statnic et al. ..... 315/247
5,680,015 A * 10/1997 Bernitz et al. ..... 315/291
5,719,471 A * 2/1998 Kachmarik ..... 315/209 R
5,834,907 A * 11/1998 Takehara ..... 315/307
6,011,351 A * 1/2000 Schemm ..... 313/493
6,324,078 B1 * 11/2001 Naruo et al. ..... 363/17

FOREIGN PATENT DOCUMENTS

JP 6-283286 10/1994

* cited by examiner

*Primary Examiner*—Douglas W. Owens
*Assistant Examiner*—Jimmy Vu
(74) *Attorney, Agent, or Firm*—DLA Piper US LLP

(57) ABSTRACT

A discharge lamp lighting apparatus, comprises a DC power supply, an inverter circuit, connected to the DC power supply, and provided with at least two switching devices, and a discharge lamp energized by the inverter circuit, wherein one switching device has an on-duty complementarily different with an on-duty of the other switching device, and wherein the inverter circuit executes a switching operation in that the on-duty of the one switching device substitutes with the on-duty of the other switching device.

10 Claims, 11 Drawing Sheets

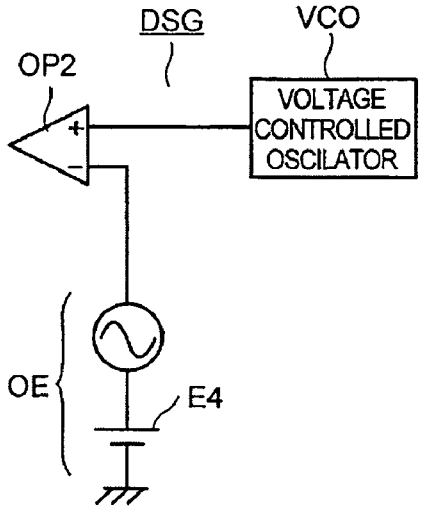
FIG. 10
FIG. 11A
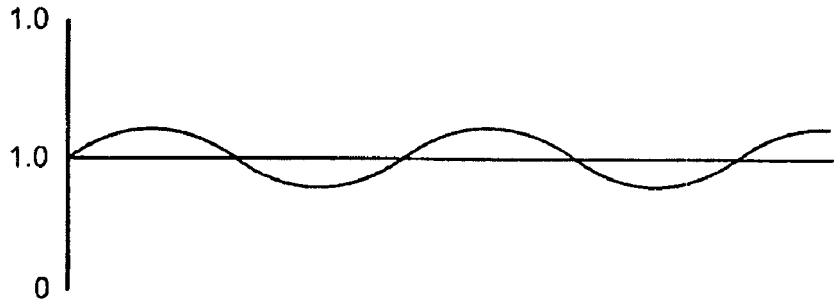
FIG. 11B
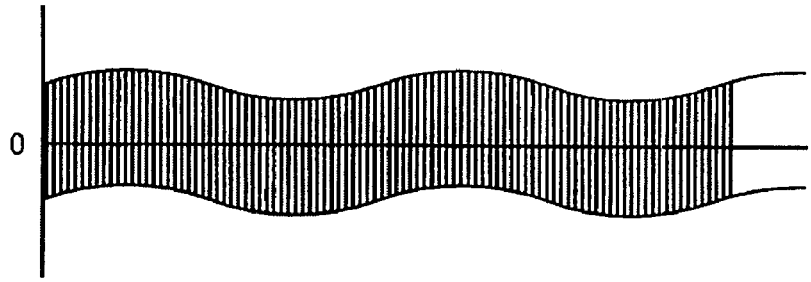

Ta=25℃

| duty \ TI | 100 μs | 200 μs | 500 μs | 1ms | 5ms | 10ms | 100ms | 1s |
|---|---|---|---|---|---|---|---|---|
| 50:50 | × | × | × | × | × | × | × | × |
| 55:45 | × | × | ○ | ○ | ○ | ○ | ○※1 | ○※1 |
| 60:40 | × | × | ○ | ○ | ○ | ○ | ○※1 | ○※1 |
| 65:35 | ○ | ○ | ○ | ○ | ○ | ○ | ○※1 | ○※1 |
| 70:30 | ○ | ○ | ○ | ○ | ○ | ○※1 | ○※1 | ○※1 |
| 75:25 | ○ | ○ | ○ | ○ | ○ | ○※1 | ○※1 | ○※1 |

FIG. 13A

Ta=0℃

| duty \ TI | 100 μs | 200 μs | 500 μs | 1ms | 5ms | 10ms | 100ms | 1s |
|---|---|---|---|---|---|---|---|---|
| 50:50 | × | × | × | × | × | × | × | × |
| 55:45 | × | × | × | × | ○ | ○ | ○※1 | ○※1 |
| 60:40 | × | × | × | × | ○ | ○ | ○※1 | ○※1 |
| 65:35 | × | × | ○ | ○ | ○ | ○ | ○※1 | ○※1 |
| 70:30 | ○ | ○ | ○ | ○ | ○ | ○※1 | ○※1 | ○※1 |
| 75:25 | ○ | ○ | ○ | ○ | ○ | ○※1 | ○※1 | ○※1 |

FIG. 13B

DISCHARGE LAMP LIGHTING APPARATUS AND LUMINAIRE

CROSS-REFERENCE TO RELATED APPLICATION

This application is based upon and claims the benefit of priority from the prior Japanese Applications; No. 2005-85995 filed on Mar. 24, 2005, No. 2005-184285 filed on Jun. 24, 2005, and No. 2006-17272 filed on Jan. 26, 2006, the entire contents of that are incorporated herein by reference.

BACKGROUND OF THE INVENTION

1. Field of the Invention

The present invention relates to a discharge lamp lighting apparatus provided with an inverter circuit having at least a pair of switching devices which alternately turn on, and a luminaire in which the discharge lamp lighting apparatus is provided.

2. Description of the Related Art

As prior art Japanese patent document Tokkai-Hei 06-283286 discloses a technique for preventing straiation in a discharge lamp by operating a pair of switching devices in a half bridge inverter circuit so as that they have on-duties being asymmetric to each other. According to the patent document, a DC current flows through the discharge lamp by the on-duties being asymmetric to each other. As a result, the straiation is suppressed so that it is hardly recognized by the human eye.

However, in the patent document, since a DC current flows through the discharge lamp, a problem arises called the cataphoresis phenomenon.

SUMMARY OF THE INVENTION

An aspect of the discharge lamp lighting apparatus according to the present invention, comprises, a DC power supply, an inverter circuit, connected to the DC power supply, and provided with at least a first switching device and a second switching device, and a discharge lamp energized by the inverter circuit, wherein the first switching device has an on-duty complementarily different with an on-duty of the second switching device, the first switching device configured to substitute its on-duty with the complementarily different on-duty of the second switching device for every predetermined period comprised of a first period and a second period. The inverter circuit executes a switching operation in that the on-duty of the first switching device substitutes with the on-duty of the second switching device, and wherein in the first period, the on-duty of the first switching device is "a" (0<"a"<1) and the on-duty of the second switching device is "1−a", and in the second period, the on-duty of the first switching device is "1−a" and the on-duty of the second switching device is "a".

BRIEF DESCRIPTION OF THE DRAWINGS

FIG. 10 is a circuit diagram of the driving signal generating circuit in the sixth embodiment of the discharge lamp lighting apparatus according to the present invention;

FIG. 11A is a graph showing the change of the on-duty "a" in a sixth embodiment of the discharge lamp lighting apparatus according to the present invention;

FIG. 11B is a lamp current waveform in the sixth embodiment of the discharge lamp lighting apparatus according to the present invention;

FIG. 13A is a table showing the evaluation result of straiation restraining action in the discharge lamp lighting apparatus according to the present invention, in an ambient temperature of 25 degrees C.;

FIG. 13B is a table showing the extent that straiation restraining function of the discharge lamp lighting apparatus according to the present invention in an ambient temperature of zero degree C.

DETAILED DESCRIPTION OF THE INVENTION

Referring now to the attached drawings, FIGS. 1 to 8, some embodiments of the present invention will be explained hereinafter.

Figure 1:
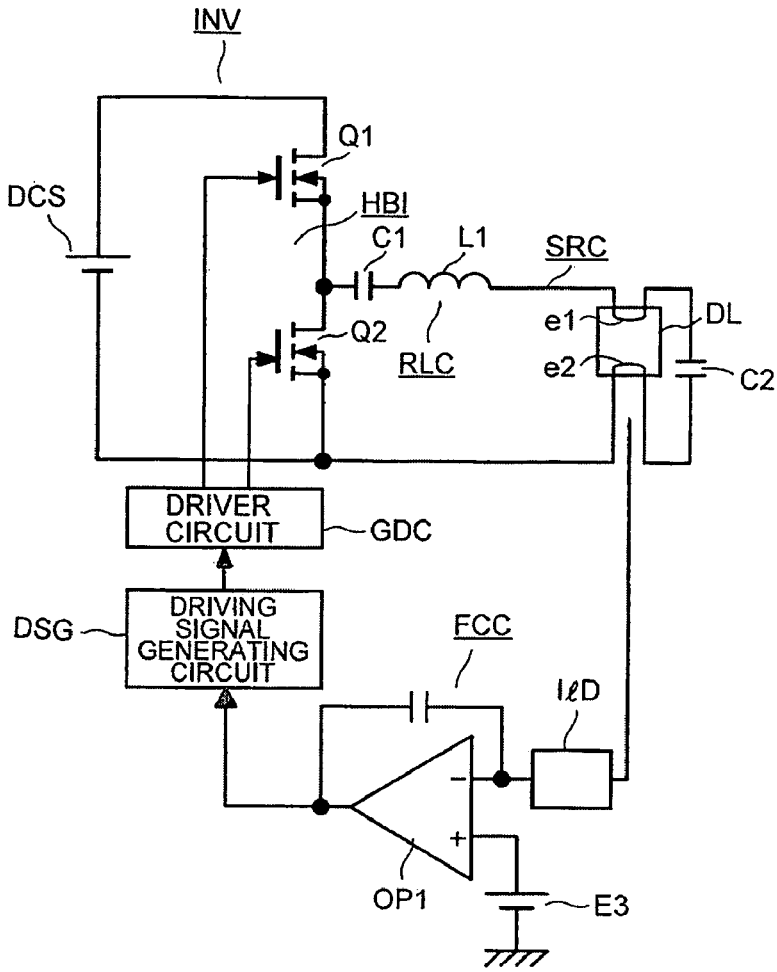
FIG. 1 is a circuit diagram of a first embodiment of the discharge lamp lighting apparatus according to the present invention.
Figure 2:
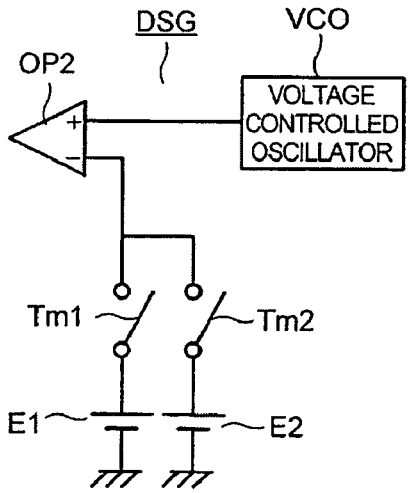
FIG. 2 is a circuit diagram showing the details of the driving signal generating circuit in the first embodiment of the discharge lamp lighting apparatus according to the present invention.

FIGS. 1 to 4 show the first embodiment of the discharge lamp lighting apparatus according to the present invention. FIG. 1 is a circuit diagram of the first embodiment of the discharge lamp lighting apparatus. FIG. 2 is a circuit diagram showing the details of the driving signal generating circuit in the first embodiment of the discharge lamp lighting apparatus. FIGS. 3A to 3E are voltage waveform diagrams for explaining the process of forming the asymmetric driving signal with complementarily different on-duties in the first embodiment of the discharge lamp lighting apparatus. FIGS. 4A and 4B are a voltage waveform diagram and a current waveform diagram for explaining the alternate asymmetric switching operation in the first embodiment of the discharge lamp lighting apparatus.

In this embodiment, the discharge lamp lighting apparatus is provided with a DC power supply DCS, an inverter circuit INV, a feedback control circuit FCC, a resonance load circuit RLC, and a discharge lamp DL.

Although details are omitted in the drawing, the DC power supply DCS rectifies a commercial AC power source voltage with a bridge rectifier circuit, and outputs a DC voltage that is obtained by smoothing the rectified voltage.

The inverter circuit INV is provided with a half bridge inverter HBI and a driving signal generating circuit DSG. The half bridge inverter HBI is provided with a pair of switching devices Q1 and Q2, and a drive circuit GDC. The pair of switching devices Q1 and Q2 are connected in series across the output electrodes of the DC power supply DCS.

Figure 3A:
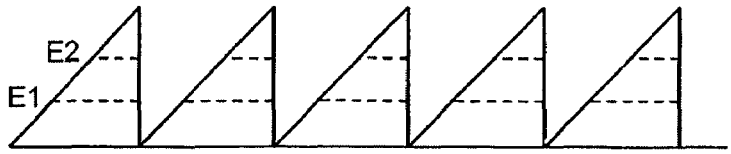
FIGS. 3A to 3E are voltage waveform diagrams for explaining the process of forming the asymmetric driving signal with complementarily different on-duties in the first embodiment of the discharge lamp lighting apparatus according to the present invention.
Figure 3B:
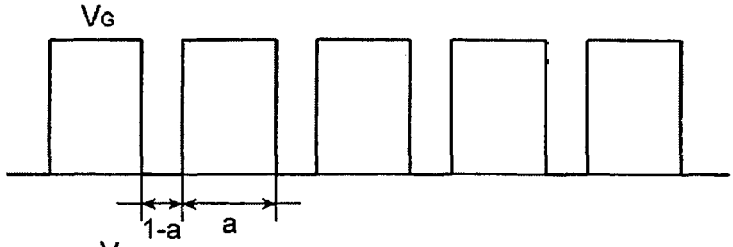
Figure 3C:
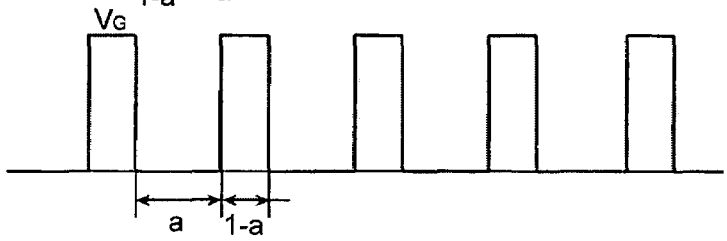
Figure 3D:
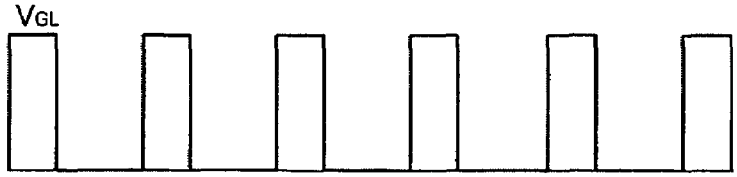
Figure 3E:
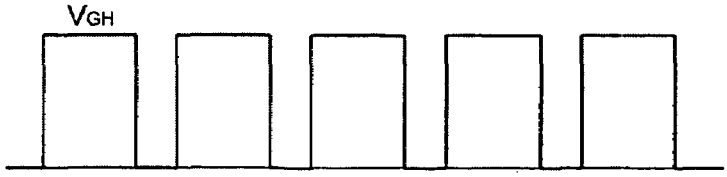

The drive circuit GDC converts an original driving signal Vg1 or Vg2, by controlling its on-duty as shown in FIG. 3B or 3C, to asymmetrical waveform driving signals Vgh and Vg1, as shown in FIGS. 3D and 3E. The Vg1 and VgZ signals are fed from the driving signal generating circuit DSG. The asymmetrical waveform driving signals Vgh and Vg1 are then supplied to the switching devices Q1 and Q2 such that the switching devices Q1 and Q2 alternately turn ON and OFF with respect to each other.

Figure 4A:
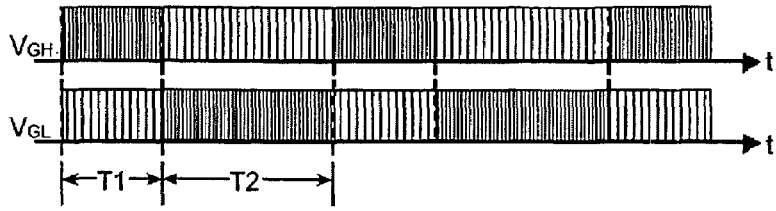
FIG. 4A is a voltage waveform diagram for explaining the alternate asymmetric switching operation in the first embodiment of the discharge lamp lighting apparatus according to the present invention.

The driving signal generating circuit DSG generates the original driving signal Vg1 and Vg2 which alternately turns ON for the first period T1 and the second period T2. The original driving signal Vg is then applied to the drive circuit GDC. In order to realize such operations, the driving signal generating circuit DSG is configured as shown in FIG. 2. That is, the driving signal generating circuit DSG is provided with a voltage controlled oscillator VCO, a second differential amplifier OP2, first and second timer means Tm1 and Tm2 and, first and second reference potential sources E1 and E2. The voltage controlled oscillator VCO generates a saw-tooth waveform oscillation voltage whose frequency changes according to the feedback control signal generated from the feedback control circuit FCC as described later. The saw-tooth waveform oscillation voltage is then applied to a non-inverting input terminal of the second differential amplifier OP2 as described later. The differential amplifier OP2 compares the saw-tooth waveform voltage applied from the voltage controlled oscillator VCO with the first and the second reference potential sources E1 and E2. The differences achieved from the comparison of the saw-tooth waveform voltage and the first and the second reference potential sources E1 and E2 are then outputted from the second differential amplifier OP2. As shown in FIG. 4A during the first period T1, the first timer Tm1 is kept in ON state. After that, the first timer means Tm1 is turned off. As shown in FIG. 4A, the second timer Tm2 is turned ON following the first period T1, and is kept in the ON state for the second period T2. After that, the second timer means Tm2 is turned off. As shown in FIG. 3B, the first reference potential source E1 applies a reference potential corresponding to the on-duty "a" to the inverting input terminal of the second differential amplifier OP2. As shown in FIG. 3C, the second reference potential source E2 applies the reference potential corresponding to the on-duty "1−a" to the inverting input terminal of the second differential amplifier OP2.

The feedback control circuit FCC generates a feedback signal by detecting a lamp current. The feedback signal is applied to the non-inverting input terminal of the second differential amplifier OP2 in the driving signal generating circuit DSG. In order to realize such operations, the driving signal generating circuit DSG is provided with a lamp current detecting circuit I1D, a first differential amplifier OP1, and a third reference potential source E3, as shown in FIG. 1. The lamp current detecting circuit 11D may be any known lamp current detecting circuit. The first differential amplifier OP1 is supplied with an output of the lamp current detecting circuit I1D to its inverting input terminal, and the third reference potential source E3 is supplied to its non-inverting input terminal. The third reference potential source E3 supplies a reference potential, i.e., a control target potential.

The resonance load circuit RLC is provided with a DC blocking capacitor C1 and a series resonance circuit SRC. The DC blocking capacitor C1 is connected at one of its terminal to a connection node of the switching devices Q1 and Q2, and at its other terminal to one terminal of the series resonance circuit SRC. The series resonance circuit SRC is a series circuit of an inductor L1 and a capacitor C2.

The discharge lamp DL is, for example, a fluorescent lamp. The capacitor C2 is then connected in series with the discharge lamp DL, between a pair of filament electrodes e1 and e2 of such a fluorescent lamp.

Now the operation of the first embodiment of the discharge lamp lighting apparatus will be explained.

That is, the inverter circuit INV converts a DC voltage supplied from the DC power supply DCS to a high frequency AC voltage and outputs the high frequency AC voltage therefrom. The high frequency AC voltage is then applied to the resonance load circuit RLC. Accordingly, the pair of the filament electrodes e1 and e2 are preheated. A resonance voltage appearing across the capacitor C2 is applied to the pair of the filament electrodes e1 and e2. As a result, the discharge lamp DL starts up, and then the operation of the discharge lamp DL lights up by shifting to an arc discharge. Here, the inductor L1 of the resonance load circuit RLC functions as a current-limiting impedance of the discharge lamp DL. Moreover, in order to complete the sequence of the preheating, the starting up and the lighting up of the discharge lamp DL, the operation frequency of the inverter circuit INV is controlled in an appropriate manner at each stage.

During operation of the discharge lamp DL, the lamp current detecting circuit I1D of the feedback control circuit FCC detects lamp current, and the first differential amplifier OP1 outputs the feedback control signal corresponding to a difference with the third reference potential source E3. The output of the first differential amplifier then serves as input to the driving signal generating circuit DSG.

The driving signal generating circuit DSG comprises a voltage controlled oscillator VCO whose frequency changes in accordance with the feedback control signal as shown in FIG. 3A. The saw-tooth wave oscillation voltage is applied to the second differential amplifier OP2, and then compared with the first reference potential source E1 or the second reference potential. As a result, the original driving signal Vg1 or Vg2 partakes the on-duty "a" or the on-duty "1□a". The original driving signal Vg1 partaking the on-duty "a" as shown in FIG. 3B appears for the first period T1. On the other hand, the original driving signal Vg2 partaking the on-duty "1−a" as shown in FIG. 3C appears for the second period T2. The original driving signals Vg1 and Vg2 respectively appearing for the first period T1 and the second period T2 are then applied to the drive circuit GDC. As a result, the driving signal Vgh for driving the switching device Q1 as shown in FIG. 3E and the driving signal Vg1 for driving the switching device Q2 as shown in FIG. 3D can be derived.

Figure 4B:
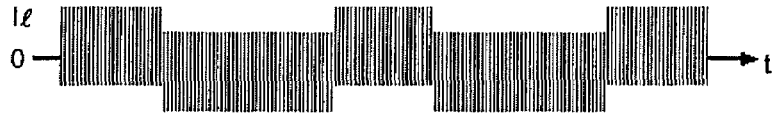
FIG. 4B is a current waveform diagram for explaining the alternate asymmetric switching operation in the first embodiment of the discharge lamp lighting apparatus according to the present invention.

It is shown that the driving signals Vgh and Vg1 have the relation that changes alternately in the first period T1 and the second period T2 as for FIG. 4A. Moreover, FIG. 4B shows the lamp current I1 that changes and flows in the first period T1 and the second period 12.

The on-duty of the driving signal Vgh in the first period T1 is relatively large, while the on-duty of the driving signal Vg1 in the same period T1 is relatively small. Therefore, as shown in FIG. 4B, a positive DC current is superposed on the lamp current I1 in the first period T1. Therefore, the operation state of the inverter circuit INV in the first period T1 takes an asymmetric switching operation.

Next, when the second period T2 comes, the relation of the on-duties of the switching devices Q1 and Q2 will invert from the state in the first period T1. At this time, the switching devices Q1 and Q2 take also an asymmetric switching operation although the relation of the on-duties invert. By this operation, in the second period T2, as shown in FIG. 4B, a negative DC current is superposed on the lamp current I1.

Since the first period T1 and the second period T2 are repeated alternately, causing an alternate asymmetric switching operation, wherein the inverter circuit INV operates by feedback control, and turns on a discharge lamp DL at a fixed brightness.

Moreover, straiation and cataphoresis phenomenon are suppressed by the above-mentioned alternate asymmetric switching operation. However, since the second period T2 is longer than the first period T1, and a so-called negative DC current, which flows in the opposite direction in the period that combined the first period T1 and the second period T2 is greater than positive DC current, cataphoresis is likely to occur than when compared to modification as described later.

In an embodiment of the present invention, each construction element can be constituted as follows.

DC power supplies can be a battery power supply or a rectified DC power supply. Further, the rectified DC power supply can be either a smoothed or a non-smoothed DC power supply. The DC-DC converter can be used as a rectified DC power supply with switching regulators. As one example, a DC chopper can be used if desired. In this case, while impressing the output voltage of a DC-DC converter to the input terminal of an inverter circuit, the lamp current or lamp power of a discharge lamp can be changed by changing the output voltage of a DC-DC converter.

The inverter circuit may be configured in a number of ways. For example, the inverter circuit may be a half bridge inverter, a full bridge inverter, etc. However, each of the inverter circuits can include at least a pair of switching devices capable of executing alternate switching operations with each other.

Moreover, the inverter circuit executes an alternate asymmetric switching operation at the pair of switching devices. That is, the relation between the on-duty "a" of one switching device (0<"a"<1) and the on-duty "1−a" of the switching device of another side is defined such that "a" is not equal to "1−a", or they are complementarity different from each other. For example, in the pair of switching devices, when the on-duty "a" of one switching device is 0.3, the on-duty "1−a" of the other switching device is 0.7. As long as the value of "a" satisfies 0<"a"<1 excepting 0.5, it may take any value.

However, the preferable ratio of the relation, "a"/"1−a", between the on-duties "a" and "1−a" varies in accordance with the length of the first and the second periods T1, T2 and an ambient temperature. According to experiments, the following results were obtained. That is, when the ratio of both on-duties is 1.2 or greater, straiation does not occur when the first and the second periods are 500 micro-seconds or greater under room temperature. Therefore, the ratio of both on-duties preferably 1.2 or greater. When the ratio of both on-duties is 1.9 or greater, when the first and the second periods are 500 micro-seconds or greater above zero degree C., straiation does not occur. Therefore, the preferable range of the ratios of both on-duties is 1.9 or greater. When the ratio of both on-duties is 2.4 or greater, and when the first and the second periods are 100 micro-seconds or more above zero degree C., straiation does not occur. Therefore, the optimal range over the ratio of both on-duties is 2.4.

Further, in the inverter circuit, the pair of switching devices executes the alternate asymmetric switching operation. That is, the first period, the on-duty of one switching device is "a" and the on-duty of the other switching device is "1−a", and in the second period the on-duty of the former switching device is "1−a", and the on-duty of the latter switching device is "a" are repeated alternately with each other. Generally, it would be preferable that the first period and the second period are equal to each other, since cataphoresis phenomenon hardly occurs in such a state.

Moreover, the lower limits of the first and the second periods may be longer than a time required for a DC current to be superposed on the lamp current by the asymmetric operation of the pair of switching devices. The upper limits, however, may be about a time that human eye fails to feel the flickering of brightness. In order to superpose DC current on the lamp current, two or more cycles of asymmetric outputs of an inverter should be achieved. Therefore, the lower limit of the first and the second periods is the time corresponding to one or more cycles of an inverter output. Moreover, although the switching operation of a switching device can be based on a time noticeable to a person, when the maximum value was 10 ms or less, satisfying the above-mentioned conditions can be achieved and verified by experiment. In addition, the inverter circuit outputs the high-frequency voltage of 40 kHz or more, the maximum value of the first and/or second periods may range between 1-5 ms.

A fluorescent lamp can be used for a discharge lamp. Of course, other types of lamps can be used. In addition, by executing wave conversion of the rectangle wave outputted from an inverter circuit at a sine wave and controlling noise occurring in the operation of the discharge lamp, the discharge lamp can be made to operate efficiently. Such efficient discharge lamp operation can be achieved by connecting a resonance load circuit to the output terminal of an inverter circuit, and to connect a discharge lamp to the inverter circuit through the resonance load circuit. Although a series resonance circuit is preferable for a resonance load circuit, when another current-limiting impedance element is connected in series to the discharge lamp, a parallel resonance circuit can also be used.

When the resonance load circuit is a series resonance circuit, the resonance impedance that executes the series connection to a discharge lamp and that is connected to an inverter circuit can serve as current-limiting impedance. In addition, when no resonance load circuit is used, it is possible to use a suitable impedance that yields a current limiting function after such impedance is connected in series with the discharge lamp, thereby executing a current limiting action.

Now the operation of the discharge lamp lighting apparatus according to the present invention will be explained below.

The pair of switching devices will execute switching operations alternately, and will execute a DC-AC conversion when the inverter circuit is connected to the DC power supply, and an AC voltage appears on the output terminal. A discharge lamp is energized by the output of an inverter circuit. When the switching operation starts, the discharge lamp executes exchange lighting.

However, since the pair of switching devices in an inverter circuit executes the asymmetric switching operation with the on-duties complementarily different from each other, a DC component is superposed on the AC lamp current flowing through the discharge lamp. As a result, the occurrence of straiation is suppressed remarkably. In addition, since the DC component becomes large as the difference of the on-duties becomes large, the difference of the on-duties can be suitably given so that a desired value of the DC component may be superposed.

Further, the asymmetric switching operation in the pair of switching devices of the inverter circuit continues for the first Period and then reverses in the second period. That is, the first and the second periods are set up in advance so that it they have a predetermined relation between them. In the first period, the on-duty of a first switching device is "a", and the on-duty of a seconds witching device is "1−a". In the second period, the on-duty is reversed, wherein the on-duty of the first switching device becomes "1−a", and the on-duty of the second switching device becomes "a". Therefore, the polarity of the DC component superimposed on the AC lamp current reverses in the first period.

Then, when the polarity reversals of the above-mentioned DC component are executed, it becomes difficult to generate cataphoresis phenomenon in a discharge lamp. Therefore, according to the present invention, straiation and cataphoresis phenomenon are suppressed remarkably.

By the way, when the lamp current or lamp power of a discharge lamp is small, it is easy to generate straiation. Then, in this invention, it permits constituting so that the above-mentioned alternate asymmetric switching operation may be carried out only when lamp current or lamp power is below a predetermined value, and the alternate asymmetric switching operation may not be executed when the lamp current or lamp power exceeds a predetermined value. In order to realize the operation, further embodiments of the present invention are described hereunder.

In an embodiment of the present invention, a discharge lamp lights up with an output of the inverter circuit varying in accordance with a lighting control signal, wherein the inverter circuit executes alternate asymmetric switching operations only when the lighting control ratio of the discharge lamp is relatively small. In addition, when a lighting control ratio is 100% the discharge lamp displays by a percentage, and all optical lightings result in 100% lighting. When a light control is 0%, the discharge lamp is putting out lights, resulting in 0% lighting. When the lighting control ratio is a middle value, then the discharge lamp lights up at a rate that corresponds to percentage values of all optical lightings. Therefore, lighting by numerical small percentage can be used at the time when a lighting control ratio is small.

In another embodiment of the present invention, the feedback control of the inverter circuit is executed by detecting the lamp current of the discharge lamp, and controlling the inverter circuit by feeding back the detected lamp current so as that the lamp current becomes below a predetermined value. And, when the detected lamp current has reached below the predetermined value, when a detection value is below a predetermined value, the inverter circuit can be configures to execute the alternate asymmetric switching operation. The construction is preferable for the case that the lamp current is changed by changing the output frequency of the inverter circuit.

In yet another embodiment of the present invention, the feedback control of the DC power supply voltage is configured so that the lamp current of the discharge lamp may be detected and the detection value may approach a predetermined value, and when a detection value is below a predetermined value, the switching devices of the inverter circuit is made to execute an alternate asymmetrical switching operation. The construction is preferable for the case that the lamp current is changed by controlling the DC power supply voltage of the inverter circuit by using a DC-DC converter such as a DC chopper as the DC power supply.

In an embodiment of the present invention, the feedback control of the inverter circuit is carried out so that the lamp power of the discharge lamp may be detected and the detection value may approach a predetermined value, and when a detection value is below a predetermined value, it is so constructed that an inverter circuit may execute the alternate asymmetric switching operation. Such an embodiment may be suitable for the case that the lamp power is changed by changing the output frequency of the inverter circuit.

In another embodiment, the feedback control of the DC power supply voltage is carried out so that the lamp power of the discharge lamp may be detected and the detection value may approach a predetermined value, and when a detection value is below a predetermined value, it is so constructed that an inverter circuit may execute the alternate asymmetric switching operation. Such an embodiment may suitable for the case that the lamp power is changed by controlling the DC power supply voltage for the inverter circuit by using a DC-DC converter such as a DC chopper as the DC power supply.

Referring now to FIGS. 5 to 10, further embodiments of the discharge lamp lighting apparatus according to the present invention will a be explained below. In addition, in each figure, the same sign is attached about the same portion as FIGS. 1 to 4, and explanation is omitted.

Figure 5A:
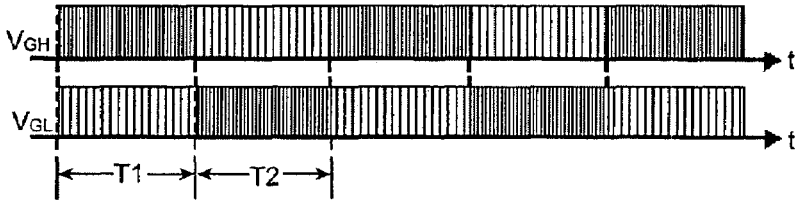
FIG. 5A is a voltage waveform diagram for explaining the alternate asymmetric switching operation in the modification of the first embodiment of the discharge lamp lighting apparatus according to the present invention.
Figure 5B:
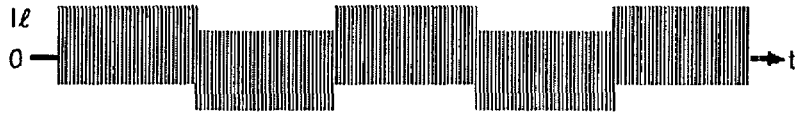
FIG. 5B is a current waveform diagram for explaining the alternate asymmetric switching operation in the modification of the first embodiment of the discharge lamp lighting apparatus according to the present invention.

FIGS. 5A and 5B are a voltage wave for explaining the alternate asymmetric switching operation in a modification of the first embodiment of the discharge lamp lighting apparatus according to the present invention, or a current waveform diagram.

In this modification, since the DC currents that flows forwardly and inversely in the period over the first period T1 and the second period T2, the DC currents are balanced out by each other, and thus cataphoresis phenomenon becomes difficult to occur.

Figure 6:
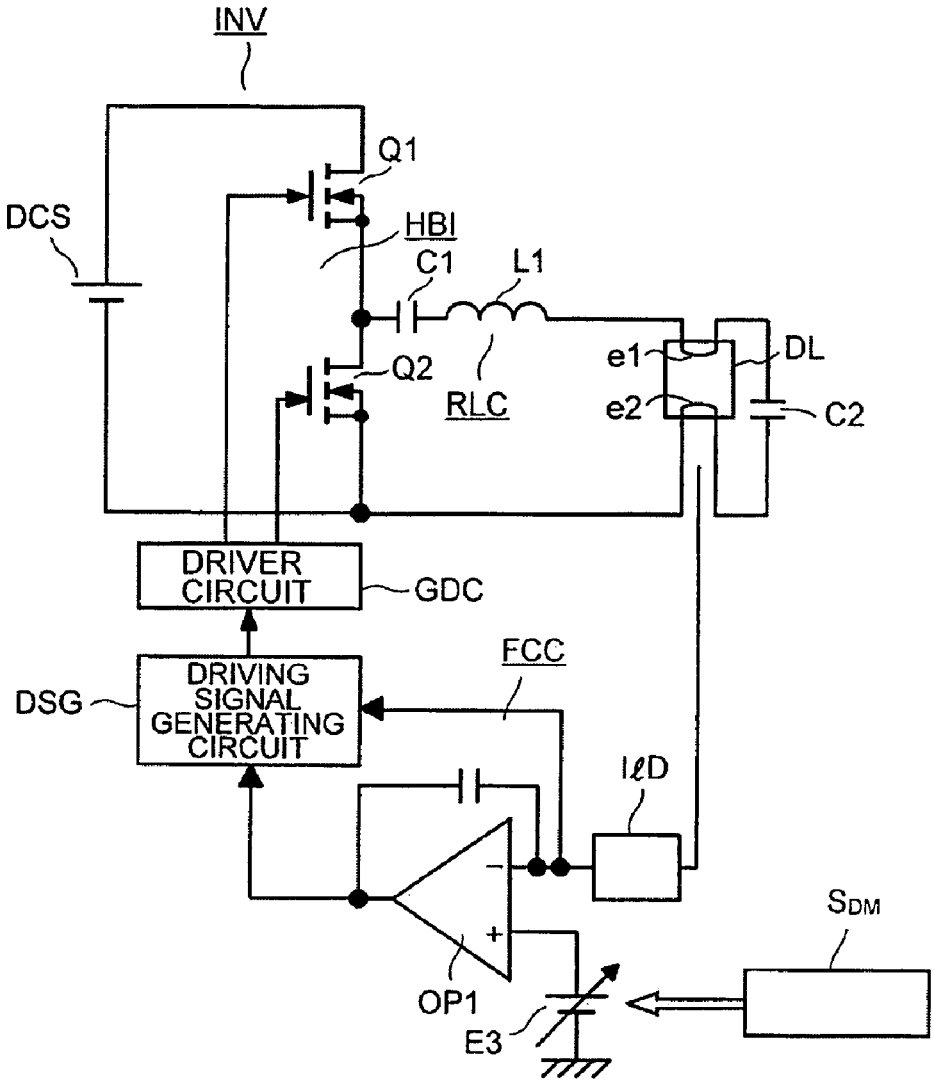
FIG. 6 is a circuit diagram of a second embodiment of the discharge lamp lighting apparatus according to the present invention.

FIG. 6 is a circuit diagram of the second embodiment of the discharge lamp lighting apparatus according to the present invention.

In this embodiment, the discharge lamp lighting apparatus is so constructed that the lamp current applied to a discharge lamp DL by lighting control signal that comes mainly from the outside may be adjusted. When the lamp current changes, the light output of a discharge lamp DL changes.

In order to realize such operations, it is so constructed that the potential of the third reference potential source E3 of the feedback control circuit FCC may change according to a lighting control signal. Therefore, the target value of the feedback control circuit changes according to the lighting control signal. Since the lamp current follows in footsteps and fluctuates in connection with this, lighting control will be executed. In addition, it is possible to construct that the alternate asymmetric switching operation may be executed only in the small range of a lighting control ratio.

Figure 7:
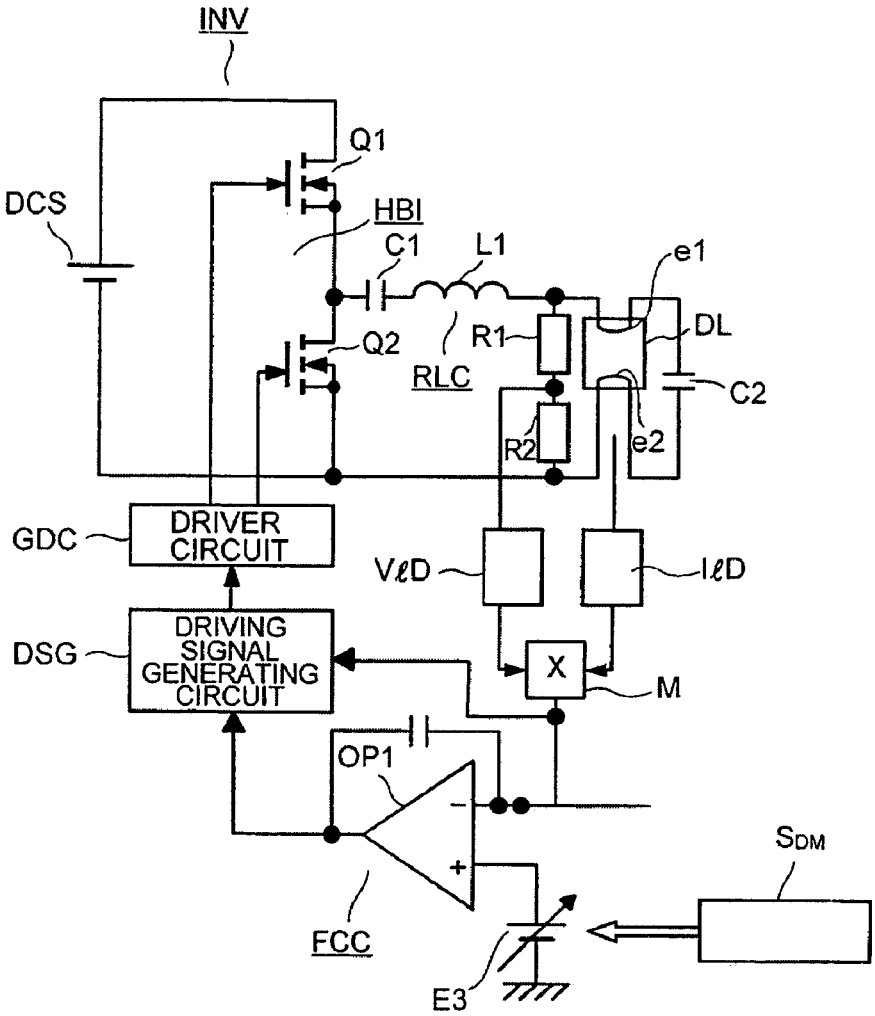
FIG. 7 is a circuit diagram of a third embodiment of the discharge lamp lighting apparatus according to the present invention.

FIG. 7 is a circuit diagram of the third embodiment of the discharge lamp lighting apparatus according to the present invention.

In this embodiment, discharge lamp lighting apparatus is so constructed that the lamp power applied to a discharge lamp DL by a lighting control signal that comes mainly from the outside may be adjusted. When the lamp power changes, the light output of the discharge lamp DL changes.

In order to realize such operations, the feedback control circuit FCC may bring lamp power close to target value, in order to realize the above-mentioned operation. The lamp current detecting circuit I1D and the ramp voltage detecting circuit VID are provided, wherein these detection values are inputted into the multiplication circuit M in order to determine the lamp power, which can then be compared with the third reference potential source E3. In addition, the ramp voltage detecting circuit VID is provided with a ramp voltage using voltage dividing circuit formed with resistors R1 and R2, and by the multiple connection to the discharge lamp DL. Others are the same in construction as those in FIG. 6.

Figure 8:
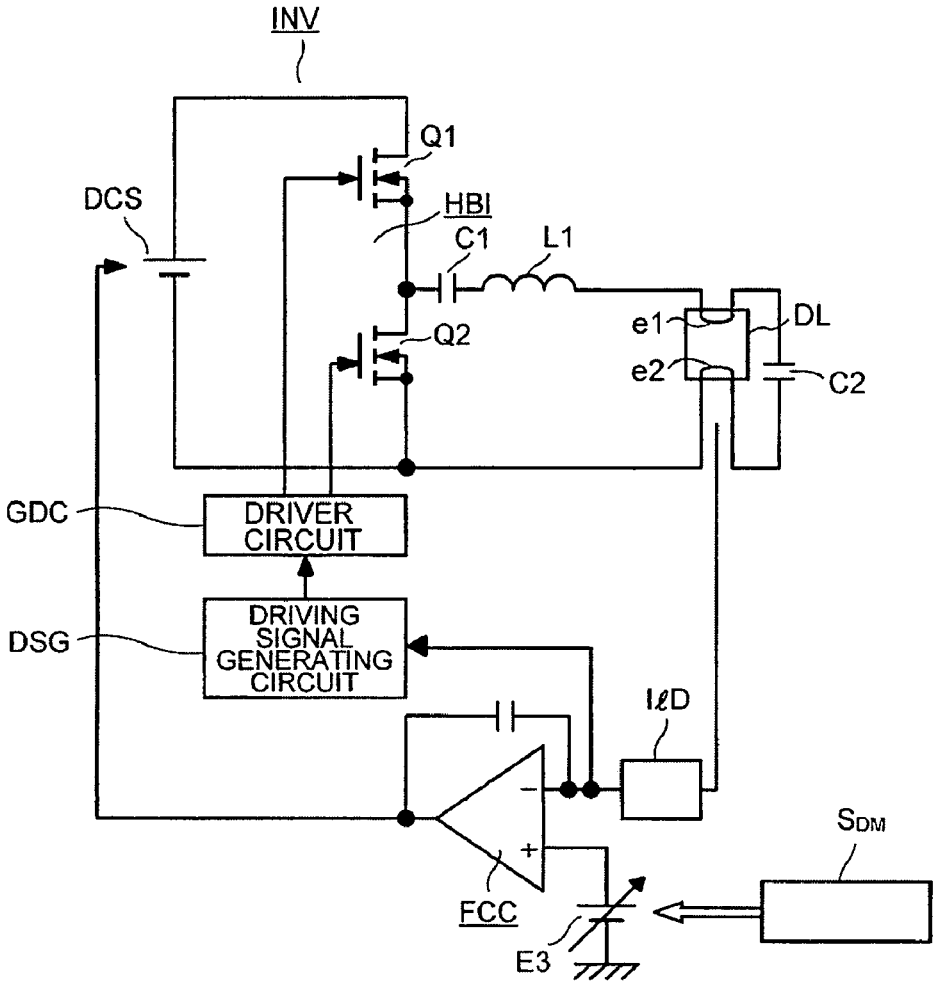
FIG. 8 is a circuit diagram of a fourth embodiment of the discharge lamp lighting apparatus according to the present invention.

FIG. 8 is a circuit diagram of the fourth embodiment of the discharge lamp lighting apparatus according to the present invention.

This embodiment is configured such that the DC power supply voltage outputted from the DC power supply DCS according to the feedback signal of the lamp current obtained from the feedback control circuit FCC may be adjusted. When the DC power supply voltage changes, the light output of a discharge lamp DL changes. Other configurations can be similar to FIG. 6.

Figure 9:
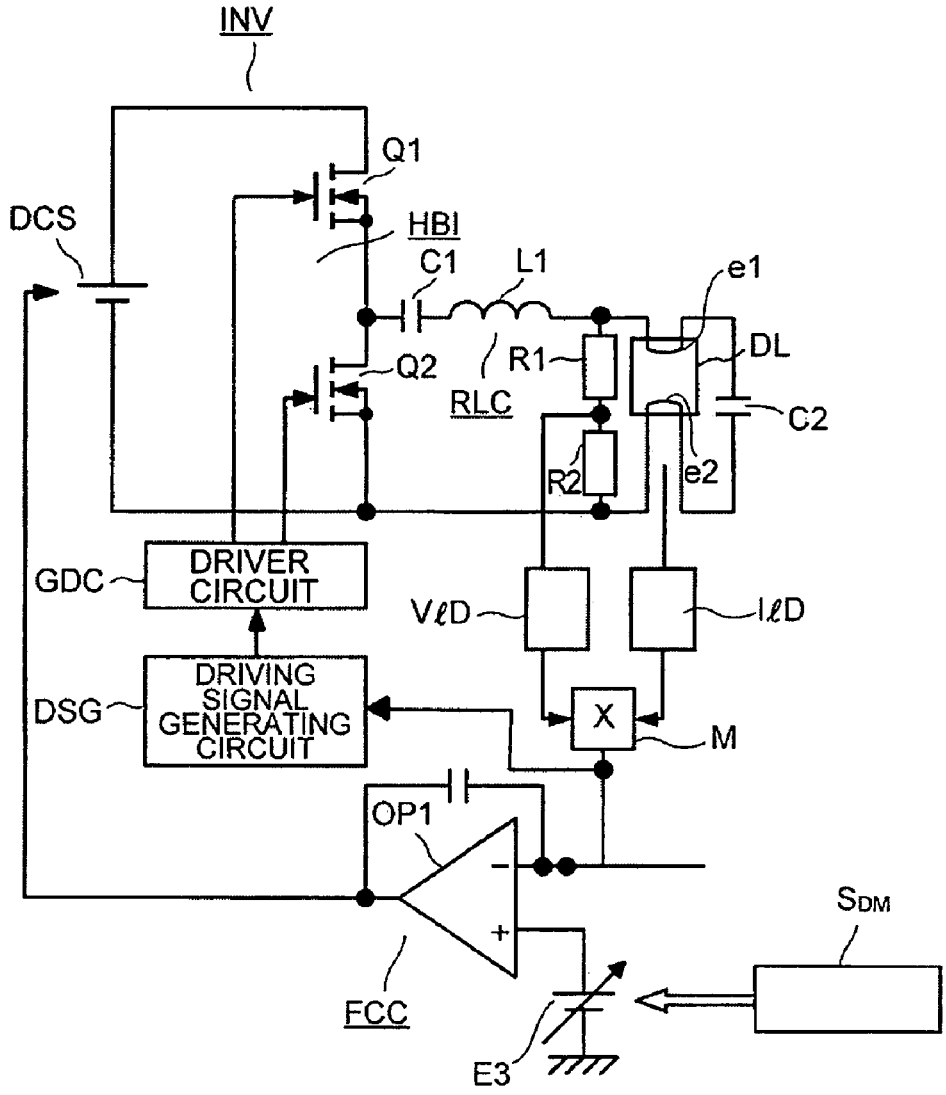
FIG. 9 is a circuit diagram of a fifth embodiment of the discharge lamp lighting apparatus according to the present invention.

FIG. 9 is a circuit diagram of the whole equipment in that the fifth embodiment of the discharge lamp lighting apparatus according to the present invention is shown.

This embodiment is configured such that the DC power supply voltage outputted from the DC power supply DCS according to the feedback signal of the lamp power obtained from the feedback control circuit FCC may be adjusted. When the DC power supply voltage changes, the light output of a discharge lamp DL changes. Other configurations can be similar to FIG. 7.

FIGS. 10, 11A and 11B show the 6th embodiment of the discharge lamp lighting apparatus according to the present invention. FIG. 10 is a circuit diagram of a driving signal generating circuit, FIG. 11A is graph showing the temporal change of the on-duty "a", and FIG. 11B is the waveform diagram of lamp current.

In this embodiment, the driving signal generating circuit DSG is provided with the voltage controlled oscillator VCO, the second differential amplifier OP2, and a pulsating reference potential source OE. The voltage controlled oscillator VCO and the second differential amplifier OP2 can be configured similar to the circuit operation of first embodiment of the discharge lamp lighting apparatus according to the present invention shown in FIG. 2.

On the other hand, the source OE of rippled type potential is the characteristic component of this embodiment, and is a device to output rippled type reference potential, and to input into the inverting input terminal of the second differential amplifier OP2. Moreover, in this embodiment, the pulsating reference potential source OE is comprised of a series circuit of a pulsating potential generator OEG and a constant potential source E4. The pulsating potential generator OEG generates a pulsating potential having a pulsating wave, such as a sinusoidal wave, a triangular wave, a trapezoidal wave that smoothly transfers from the positive half-wave state to the negative half-wave state, and vice versa. The pulsating reference potential source OE generates a fixed DC potential. Therefore, the reference potential that the pulsating reference potential source OE generates turns into DC potential from that the instantaneous value changes to the above-mentioned oscillatory waveform.

The lamp current in this embodiment is a high frequency AC current in which the average of the on-duty in the first period takes "a" while the average of the on-duty in the second period takes "1−a", and the on-duties change gradually along the lines of the pulsating wave in each of the first and the second periods, as shown in FIG. 11B. Moreover, in addition to this, the envelope curve of the high frequency AC voltage current in lamp current is vibrating synchronizing with the above-mentioned pulsating wave.

In FIG. 11A the graph illustrates the on-duty "1−a" of the 180 degrees phase difference with respect to the on-duty "a". As a result of the changing shape of a sinusoidal AC waveform over time, the waveform of the lamp current modulates causing the discharge lamp DL to light up. A stress caused in the inverter circuit is reduced, and thus, causing both the straiation and cataphoresis phenomena of a discharge lamp to be suppressed, when such lamp current flows.

Figure 12A:
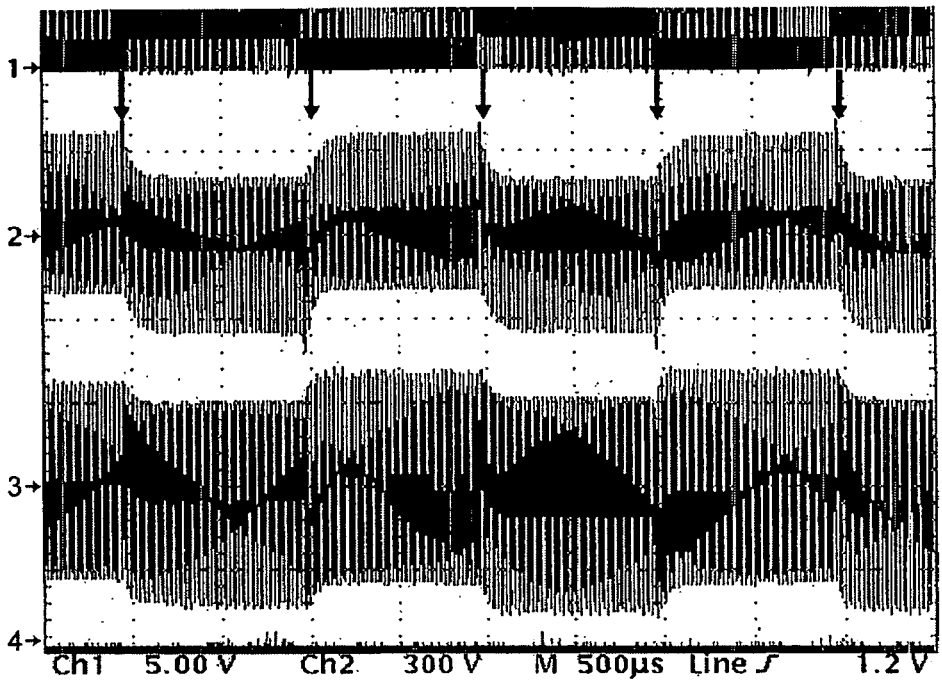
FIG. 12A is a lamp current waveform of the discharge lamp lighting apparatus according to the present invention.
Figure 12B:
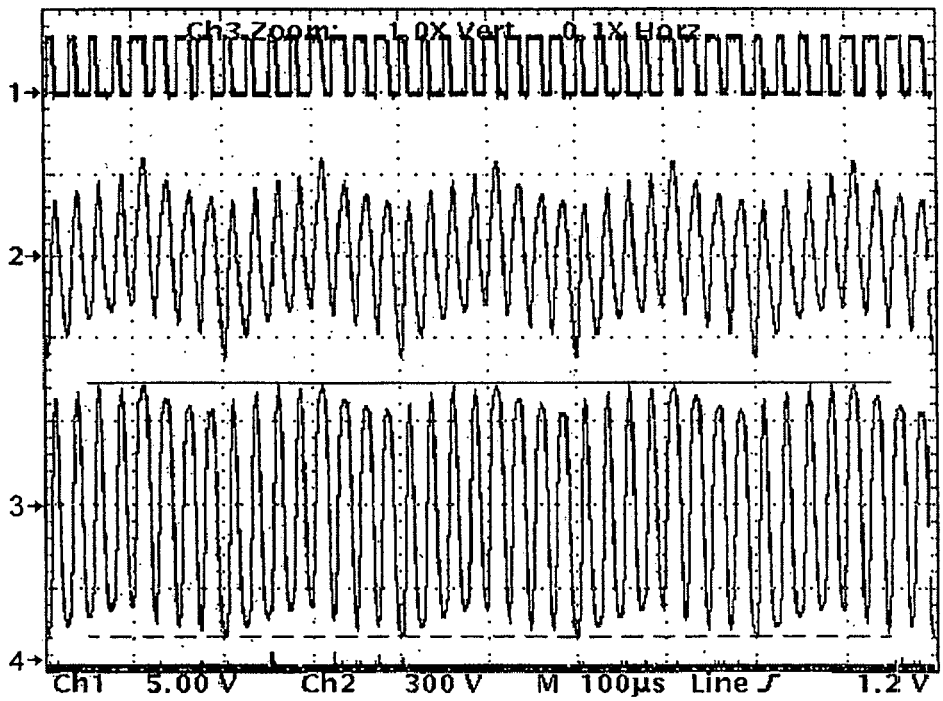
FIG. 12B is a lamp current waveform diagram in a conventional discharge lamp lighting apparatus.

Referring now to FIGS. 12A and 12B, the relation of the first and the second periods relating to carrying out the alternate asymmetric switching operation in the discharge lamp lighting apparatus and the striation according to the present invention will be explained below.

FIGS. 12A and 12B show the discharge lamp lighting apparatus according to the present invention, and the lamp current waveform of the conventional example by comparison. In FIGS. 12A and 12B, the downward-pointing arrows on each, graph indicate the turning points between the first period and the second period. In the present invention, a duration of about 0.8 ms in which the peak value of the current is being kept constant exists from a transition period of about 100-200 microseconds that starts at an instant of turning into the first period or the second period until the operation turns to the second period or the first period, as shown in FIG. 12A. Accordingly, a DC current is superposed on the high frequency current, resulting in straiation being suppressed. In addition, the first and the second periods are approximately 1 ms.

On the other hand, since the comparative example is so configured that the first or the second period changes to the second or the first period in a transitional period that starts at an instance that the first or the second period has changed in the second or the first period, there is no period that the peak value of the current takes a fixed steady state, as shown in FIG. 12B. Thereby, since a DC current fails to be superposed on the high frequency AC current, it becomes difficult to suppress the occurrence of straiation. Also, the duration of first and the second periods are approximately 100 micro-seconds.

Referring now to FIGS. 13*a* and 13B, an influence of the first and the second periods and the on-duties of the switching devices on the straiation in the discharge lamp lighting apparatus according to the present invention will be explained hereafter.

FIGS. 13A and 13B show evaluation results of suppressing actions of the discharge lamp lighting apparatus according to the present invention for situations where straiation occur in the discharge lamp. FIG. 13A is a table showing the evaluation result at an ambient temperature of 25 degrees C. FIG. 13B is a table showing the evaluation result at an ambient temperature of zero degrees C. In the tables of FIGS. 13A and 13B, T1 is the first period, T2 is the second period, and "duty" represents the on-duties "a" and "1−a", respectively. Moreover, "O" represents "straiation not recognized", "X" represents "straiation recognized", and "*" represents "positive column fluctuation recognized".

As analyzed from the tables of FIGS. 13A and 13B, according to the present invention, straiation is suppressed for the range of 100 micro-seconds to 10 ms, by the relation of the on-duties being defined in "a" not equal to "1−a".

Figure 14:
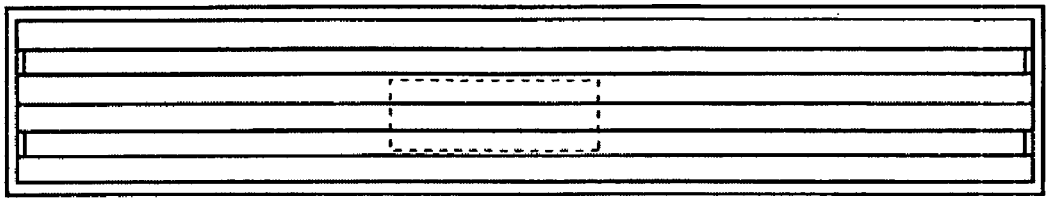
FIG. 14 is a bottom view provided with the discharge lamp lighting apparatus of the present invention showing the ceiling flush type luminaire according to the present invention.

FIG. 14 is a bottom view showing a ceiling flush type luminaire according to an embodiment of the present invention which is provided with any discharge lamp lighting apparatus as mentioned above.

The luminaire according to an embodiment of the present invention is characterized by comprising a luminaire chassis, and the discharge lamp lighting apparatus is provided with a luminaire chassis.

This luminaire is a concept containing all pieces of the equipment using luminescence of a discharge lamp such as, a light, a beacon light, a telltale light, ornament light, etc. The body of the luminaire is a construction object that accomplishes the base for equipping discharge lamp lighting apparatus, and forms a luminaire conjointly with discharge lamp lighting apparatus.

This luminaire is provided with the luminaire chassis 1, and a discharge lamp lighting apparatus 2. In the discharge lamp lighting apparatus 2, its electric circuit unit is arranged on the back of the luminaire chassis 1, and the discharge lamp DL is arranged on the undersurface of the luminaire chassis 1.

According to the discharge lamp lighting apparatus and the luminaire provided with the discharge lamp lighting apparatus according to the present invention, straiation phenomenon and cataphoresis phenomenon can be commonly suppressed by such simple construction.

In addition, it cannot be overemphasized that modification implementation is variously possible for this invention in the range that does not deviate not only from the above-mentioned embodiment but from the main point of invention.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A discharge lamp lighting apparatus, comprising:

a DC power supply;

an inverter circuit, connected to the DC power supply, and provided with at least a first switching device and a second switching devices; and a discharge lamp energized by the inverter circuit, wherein the first switching device has an on-duty complementarily different with an on-duty of the second switching device, the first switching device configured to substitute its on-duty with the complementarily different on-duty of the second switching device for every predetermined period comprised of a first period and a second period, wherein the inverter circuit executes a switching operation in that the on-duty of the first switching device substitutes with the on-duty of the second switching device, and wherein in the first period, the on-duty of the first switching device is "a" (0<"a"<1) and the on-duty of the second switching device is "1−a", and in the second period, the on-duty of the first switching device is "1−a" and the on-duty of the second switching device is "a".

2. A discharge lamp lighting apparatus as claimed in claim 1, wherein the switching operation of the inverter circuit is executed at a prescribed low output state of the inverter circuit.

3. A discharge lamp lighting apparatus as claimed in claim 2, wherein the output of the inverter circuit is controlled by a lighting control signal.

4. A discharge lamp lighting apparatus as claimed in claim 3, wherein the predetermined period is 10 ms or less.

5. A discharge lamp lighting apparatus as claimed in claim 4, wherein the on-duty of the first switching device gradually changes to the on-duty of the second switching device at the time that at least the switching operation of the inverter circuit transits from the first period to the second period.

6. Luminaire, comprising:

a luminaire chassis; and a discharge lamp lighting apparatus as defined in claim 1, which is provided on the luminaire chassis.

7. Luminaire, comprising:

a luminaire chassis; and a discharge lamp lighting apparatus as defined in claim 2, which is provided on the luminaire chassis.

8. Luminaire, comprising:

a luminaire chassis; and a discharge lamp lighting apparatus as defined in claim 3, which is provided on the luminaire chassis.

9. Luminaire, comprising:

a luminaire chassis; and a discharge, lamp lighting apparatus as defined in claim 4, which is provided on the luminaire chassis.

10. Luminaire, comprising:

a luminaire chassis; and a discharge lamp lighting apparatus, as defined in claim 5, which is provided on the luminaire chassis.

* * * * *